US006434769B1

(12) United States Patent
Koenig

(10) Patent No.: US 6,434,769 B1
(45) Date of Patent: Aug. 20, 2002

(54) THEMATIC CHARACTER PILLOW WITH RECREATIONAL SLEEP ENHANCING ACCESSORIES

(76) Inventor: Eric Koenig, 8 E. Carver St., Huntington, NY (US) 11743

( * ) Notice: Subject to any disclaimer, the term of this patent is extended or adjusted under 35 U.S.C. 154(b) by 0 days.

(21) Appl. No.: 09/252,547

(22) Filed: Feb. 19, 1999

Related U.S. Application Data

(60) Provisional application No. 60/075,136, filed on Feb. 19, 1998.

(51) Int. Cl.[7] ..... A47G 9/00; A63H 3/02

(52) U.S. Cl. ..... 5/636; 5/639; 5/640; 446/73; 446/369

(58) Field of Search ..... 5/636, 639, 640, 5/645, 655, 657, 904; 446/73, 369, 330, 353; D6/564, 598, 601

(56) References Cited

U.S. PATENT DOCUMENTS

| | | | | | |
|---|---|---|---|---|---|
| D160,223 | S | * | 9/1950 | Smith | 5/636 X |
| 2,961,668 | A | * | 11/1960 | Hayes | 5/636 X |
| 3,840,916 | A | * | 10/1974 | Jennings | 5/655 |
| 4,197,604 | A | * | 4/1980 | Nakamura | 5/640 |
| 4,372,077 | A | * | 2/1983 | Balbuena | 446/73 |
| 4,516,951 | A | * | 5/1985 | Saigo et al. | 446/330 X |
| 4,538,310 | A | * | 9/1985 | Scott | 5/655 |
| 4,754,512 | A | * | 7/1988 | Chao-Yang | 5/482 |
| 4,768,245 | A | * | 9/1988 | Dutton | 5/636 |
| 4,853,994 | A | * | 8/1989 | Ekstein | 5/639 |
| 4,874,340 | A | * | 10/1989 | Smallwood | 5/639 X |
| 4,878,871 | A | * | 11/1989 | Noto | 446/302 |
| D309,391 | S | * | 7/1990 | King et al. | D6/601 |
| 4,959,879 | A | * | 10/1990 | Marxhausen | 5/636 |
| 5,027,457 | A | * | 7/1991 | Sweet | 5/640 |
| 5,059,149 | A | * | 10/1991 | Stone | 446/73 |
| 5,326,300 | A | * | 7/1994 | Sanders | 446/369 X |
| 5,374,216 | A | * | 12/1994 | Jung et al. | 446/330 X |
| 5,393,257 | A | * | 2/1995 | Spector | 446/73 X |
| 5,470,270 | A | * | 11/1995 | Beamon, Jr. et al. | 446/330 X |
| 5,509,157 | A | * | 4/1996 | Story | 5/636 X |
| 5,713,741 | A | * | 2/1998 | DeMars | 5/639 X |
| 5,749,764 | A | * | 5/1998 | Bailey | 446/369 X |
| 6,030,274 | A | * | 2/2000 | Kaplan | 446/369 |

* cited by examiner

*Primary Examiner*—Terry Lee Melius
*Assistant Examiner*—Robert G. Santos
(74) *Attorney, Agent, or Firm*—Alfred M. Walker

(57) ABSTRACT

A dual purpose plush, toy characters is used as both a sleep enhancer toy and headrest pillow. The combined plush character headrest pillow includes a pouch with manually movable recreational members, such as storybooks or puppets, inserted therein to help a young child fall asleep comfortably. The plush character toy may also be an elongate amphibian type of animal, such as a lizard or worm, wherein a concave spinal portion of the animal is an orthopedically correct pillow headrest. Puppets may be provided within a hollow portion within the plush character toy, so that after the pillow portion is pivoted down, a further puppet stage set with a pop up type landscape or fantasy scene is erected by spring action upon a base portion of the puppet stage set. Thereafter, the child can insert his or her hand within an open proximal end of an attached sleeve portion, wherein at a distal end thereof there are provided the puppet portion, such as a plurality of finger puppets or a single hand puppet. The plush character toy is preferably made of a soft cuddly fabric, with a soft interior such as foam. On its outside the exterior of the animal may include a soft artificial fur or felt type fabric exterior, with optional exaggerated anthrpomorphic features, such as faces, eyes, a smiling mouth, and soft but slightly firm limbs.

12 Claims, 5 Drawing Sheets

THEMATIC CHARACTER PILLOW WITH RECREATIONAL SLEEP ENHANCING ACCESSORIES

RELATED APPLICATIONS

This application claims the benefit of U.S. Provisional Application Ser. No. 60/075,136, filed Feb. 19, 1998, which is hereby incorporated by reference in its entirety herein.

FIELD OF THE INVENTION

The present invention relates to plush, toy characters and their use as a sleep enhancer toy and headrest pillow and movable recreational members, such as story books or puppets, inserted therein.

BACKGROUND OF THE INVENTION

It is desirable to use toy character dolls and storybooks to help a young child fall asleep comfortably.

The background art does include plush toy characters, such as teddy bears, which sometimes also function as headrest pillows. For example, Oriental Trading Company of Omaha, Nebr., in its 1998 Easter Catalog #154A describes a product entitled BEDTIME BUDDIES which are hollow pillow cases with an animal character head and animal limbs attached at peripheral edges thereof. Conventional pillows are inserted within the pillow cases to fill out the hollow pillow cases and then simulate a three dimensional animal doll which also functions as a headrest pillow. Auxiliary puppets are removable attachable to an exterior portion of one of the limbs by VELCRO® or other attachments. However, the BEDTIME BUDDIES are pillowcases, not orthopedically correct headrests themselves, nor are they character dolls having pivotable members therein, such as pivotable headrest pillows and/or pivotable soft puppet theater showcases therein.

Among background art patents includes U.S. Pat. No. 5,509,157 of Story for a pillow case with animal or character appendages, such as similar to the above noted BEDTIME BUDDIES pillow case dolls.

In addition, U.S. Pat. No. 5,208,934 of Bachnick describes a bed spread with an attached animal head in one corner thereof. U.S. Pat. No. 5,115,528 of Lamle discloses a head rest pillow with an integral outer cover which turns inside out to reveal padding in animal shaped paddings. When in use as a headrest pillow, the animal shaped paddings are folded inside the integral outer cover.

Another transformable pillow is noted in U.S. Pat. Nos. 4,763,369 and 4,670,924, both of Spector, which each includes a conventional pillow having the head and body of an animal character superimposed thereon, wherein removable drawstrings are provided to constrict the pillow below the head portion to simulate a neck thereat, and below a waist portion to simulate a hip portion thereat.

U.S. Pat. No. 5,027,457 of Sweet describes a pillow having semi-circular limbs extending therefrom, which, together with a character face superimposed upon the pillow itself, form a character doll against which a user, such as a child, may rest.

U.S. Pat. No. 4,719,656 of Godinet describes a bed and mattress formed of a plurality of puzzle like intersecting pillows portions in the shape of animals, wherein the animals can be separately removed to act as plaything toys.

U.S. Pat. No. 5,127,117 of Bridges discloses a pillow with a loose pouch for partial insertion of the head of a user therein to reduce light to the eyes and to increase warmth to the sinus area, for therapeutic enhancement of sleep.

U.S. Pat. No. Design D256,414 of Rich describes an ornamental stuffed pillow with a horse head attached thereto and U.S. Pat. No. Design D341,979 of Peters describes a combined blanket with attached pillow portion and pouch attached thereto.

Other related patents include U.S. Pat. No. 5,522,507 of Cruz for a tooth fairy kit which includes a pillowcase with a sewn-in pouch for insertion of a tooth and reward therein, U.S. Pat. No. 4,054,204 of Keeton for a method of making a compressed foam article, such as a character doll or pillow, U.S. Pat. No. 4,788,916 of Saxton for a food tray for a bed ridden person wherein the tray is supported beneath by a pillow, U.S. Pat. No. Design D329,566 of Davidson for a grid shaped pillow, and U.S. Pat. No. 5,537,703 and U.S. Pat. No. Design D364,986 both of Launder for an orthopedically correct pillow with a depressed head support portion and a plurality of compressible fins underneath.

Furthermore, some storybooks for young children are made of fabric, so that they will be cuddly and soft when held by a young child. However, these fabric based storybooks are not provided as part of an orthopedically correct headrest pillow as part of a plush character toy, nor are they hidden within a pouch, so that a young child can learn that important objects can be temporarily stored and put away after use, and then retrieved at a later appropriate time.

However, none of the background art publications or patents describe a character pillow with anthropomorphic facial and limb features wherein the pillow opens up to reveal either a pivotable pillow or puppet theater showcase, or both.

OBJECTS OF THE INVENTION

It is an object of the present invention to use toy character dolls and storybooks to help a young child fall asleep comfortably.

It is also an object of the present invention to provide plush toy characters which also function as headrest pillows, wherein the plush toy character pillows have a depressible head rest portion to accommodate the head and neck of a child user.

It is yet another object of the present invention to provide plush toy characters as orthopedically correct headrest pillows.

It is yet a further object of the present invention to provide a storybook for young children which are cuddly and soft when held by a young child.

It is yet another object of the present invention to provide a storybook or puppet theater hidden within a pouch of a plush character toy, so that a young child can learn that important objects can be temporarily stored and put away after use, and then retrieved at a later appropriate time.

It is yet another embodiment to improve over the disadvantages of the background art.

SUMMARY OF THE INVENTION

In keeping with these objects and others which may become apparent, the present invention relates to dual purpose plush, toy characters which are used as both a sleep enhancer toy and headrest pillow. Preferably, the combined plush character headrest pillow includes an openable pouch with manually movable recreational members, such as storybooks or puppets, inserted therein. The plush toy character dolls and storybooks help a young child fall asleep comfortably.

The pillow may be already stuffed with soft supportive material, or it may be a hollow pillowcase, to be stuffed by pillow material.

In one optional embodiment, the plush character toy can be provided in a sitting up position, so that when the headrest pillow is kept within the pouch in an unpivoted position of non-use, the posture of the plush character toy in an upright seated position functions as a bolster for a partially seated reclining child, or for a child in a prone position.

Optionally, the plush character toy may also be provided as an elongate amphibian type of animal, such as a funny lizard or worm, wherein a concave spinal portion of the lizard or worm functions as an orthopedically correct pillow headrest. In such a case, the head of the elongate amphibian type of animal may optionally function as pedestal support for a storybook or other recreational accessory for the child in its habits of falling asleep comfortably.

By the term orthopedically correct, it is referred to as a pillow having a correct depressible head and neck portion within a pillow body, to distinguish from the incidental use of a soft doll as a pillow, which may not have a correct depressible portion therein.

The plush toy characters of the present invention, such as teddy bears, are orthopedically designed wherein pivotable pillow portions are provided within the abdomen portions of the plush character toy, so that when pivoted outward and down they also function as a headrest pillows between soft cuddly limbs, such as arms and legs, of the plush character toy. These soft cuddly limbs can be grasped by the arms of a sleeping child, for comfort and security.

The puppets and storybooks for young children are preferably cuddly and soft when held by a young child. And are preferably hidden within a pouch within the abdomen portion of the plush character toy, so that a young child can learn that important objects can be temporarily stored and put away after use, and then retrieved at a later appropriate time.

The puppets may be provided within a hollow portion within the plush character toy, so that after the pillow portion is pivoted down, a further puppet stage set with a pop up type landscape or fantasy scene is erected by spring action upon a base portion of the puppet stage set. Thereafter, the child can insert his or her hand within an open proximal end of an attached sleeve portion, wherein at a distal end thereof there are provided the puppet portion, such as a plurality of finger puppets or a single hand puppet. Optionally, the puppet stage may be removable from the character pillow.

The plush character toy is preferably made of a soft cuddly fabric, with a soft interior such as foam. On its outside the exterior of the animal may include a soft artificial fur or felt type fabric exterior, with optional exaggerated anthrpomorphic features, such as faces, eyes, a smiling mouth, and soft but slightly firm limbs.

Optionally, the dual purpose plush character toy pillow headrest may be attached to an animation motor to move parts thereof, or to an audio component to play back recorded audio segments, such as portions of an appropriate story.

BRIEF DESCRIPTION OF THE DRAWINGS

The present invention can best be understood in connection with the accompanying drawings, in which:

As shown in FIG. 1–3, pillow 1 has a longituditional axis extending along lines 1*a*–1*b* of FIGS. 1 and 1A from an upper head and face portion 1*a*, having anthropomorphic features 5, down to a lower base portion 1*b*. Pivotable pillow portion 4 pivots in an axis parallel to the longitudinal axis extending along lines 1*a*–1*b*, from a closed position within pillow 1, above a space 1*c* between a pair of lower limbs 9, 10, to an open position located between lower limbs 9, 10, wherein a distal end portion 4*c* of pivotable pillow 4 extends adjacent to respective distal end portions 9*a*, 10*a* of said lower limbs 9, 10. In a further embodiment shown in FIG. 2A, pivotable pillow 4 may have a further foldable portion 4*a* pivoting longitudinally away from distal end portion 4*c* of pivotable pillow 4.

DETAILED DESCRIPTION OF THE DRAWINGS

Figure 1:
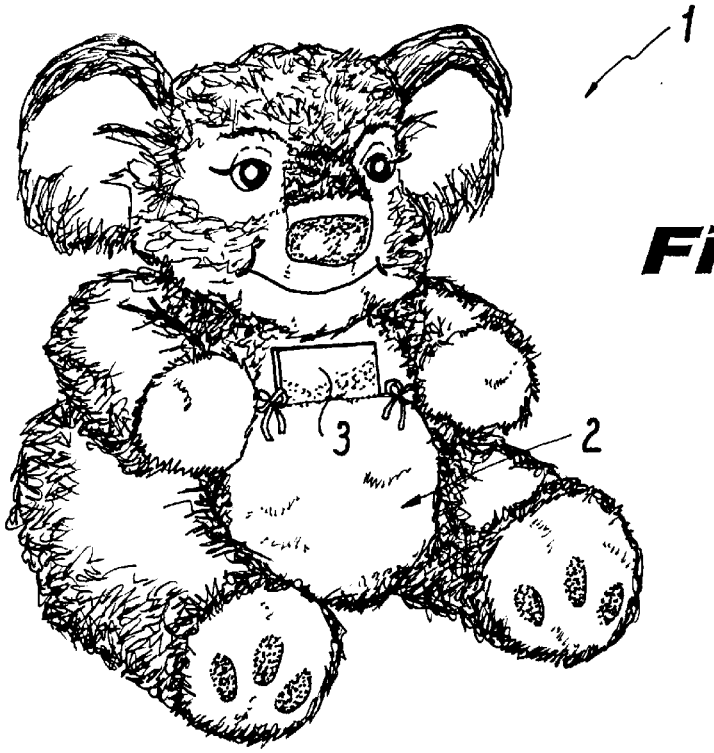
FIG. 1 is an isometric view of a plush character toy headrest pillow in accordance with the present invention, wherein the pivotable pillow portion is shown in a closed position.

FIG. 1 shows plush character toy headrest pillow 1 with soft, fuzzy, pivotable pouch portion 2 holding optional manual accessory 3, such as a storybook therein. Pivotable pouch portion 2 is shown in a closed position. In such closed position, plush character toy headrest pillow 1 functions alternately as a bolster for a sitting, partially reclining child leaning thereat.

Figure 2:
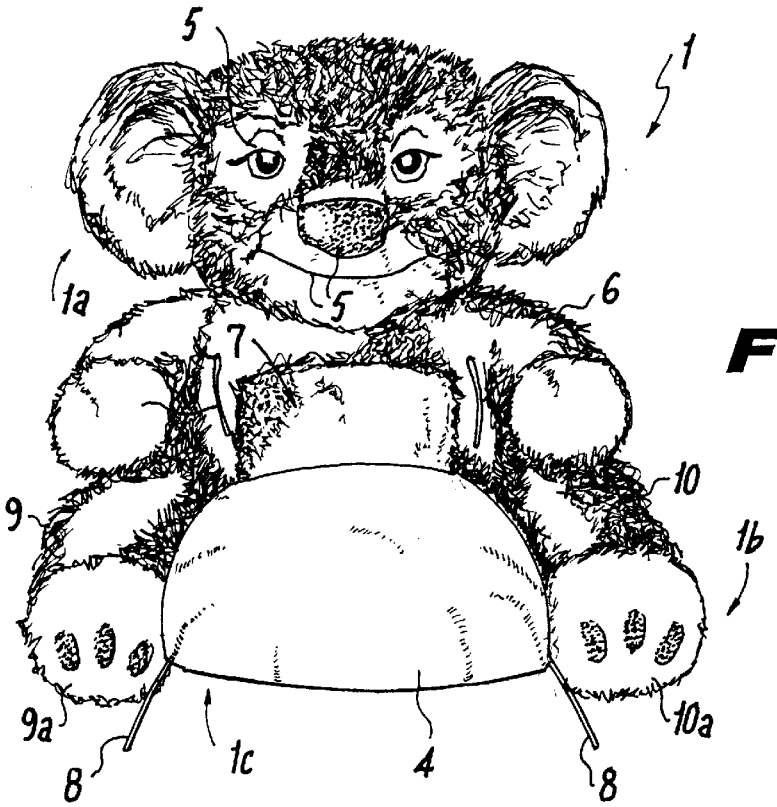
FIG. 2 is a front elevational view thereof, wherein the pivotable pillow portion is shown in an open position of use.

FIG. 2 is shows plush character toy headrest pillow 1 with soft, fuzzy, pivotable pouch portion 2 open, thereby exposing orthopedically correct fold out pillow with a flexible hinge, in an open position of use. Plush character toy headrest pillow 1 also includes anthropomorthic features 5, such as eyes, a nose and smiling mouth. Plush character toy headrest pillow 1 is covered by a soft fuzzy fabric, such as artificial fur of natural or artificial fabrics. When exposed, pillow portion 4 includes flexible hinges such as ties or VELCRO® attachment members at corner ends thereof, which are attachable to corresponding flexible hinges such as ties or VELCRO® attachment members upon inner abdomen wall portion 7 of plush character toy headrest pillow 1.

Figure 3:
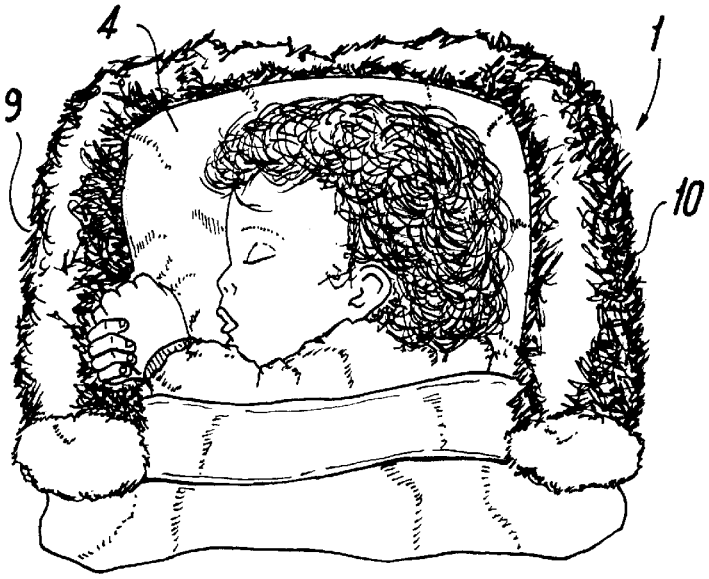
FIG. 3 is a front isometric close-up view of the plush character toy headrest pillow shown with a child asleep thereon.

Plush character toy headrest pillow 1 also includes anthropomorthic limbs 9, 10, such as arms or legs, which as shown in FIG. 3, may be grasped by a sleeping child for comfort and security.

Figure 4:
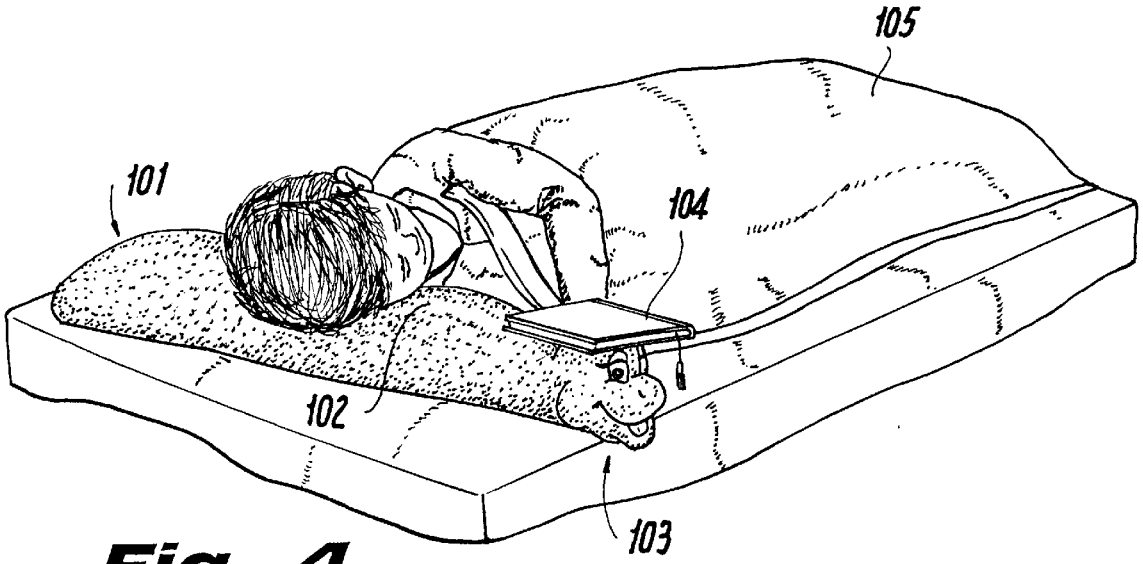
FIG. 4 is an isometric view of an alternate embodiment for an elongate amphibian type of character toy pillow, shown with a child asleep thereon.
Figure 5:
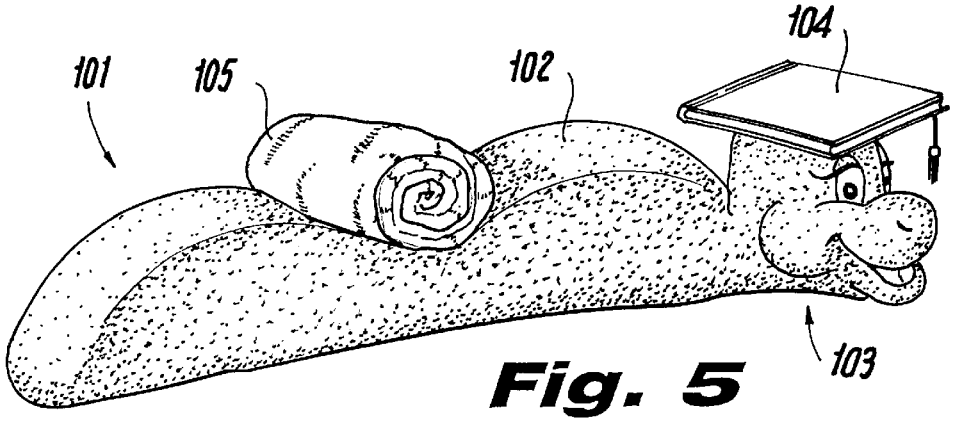
FIG. 5 is a close-up isometric view thereof.

FIG. 4 is shows an alternate embodiment for an elongate amphibian type of character toy pillow 101, shown with a child asleep thereon;

FIG. 5 shows elongate amphibian type of character toy pillow 101 with orthopedically correct concave pillow portion 102 and pedestal support 103 holding manual accessory 104, such as a storybook.

As also shown in FIG. 4, auxiliary blanket 105 may also be provided for a sleeping child.

Figure 6:
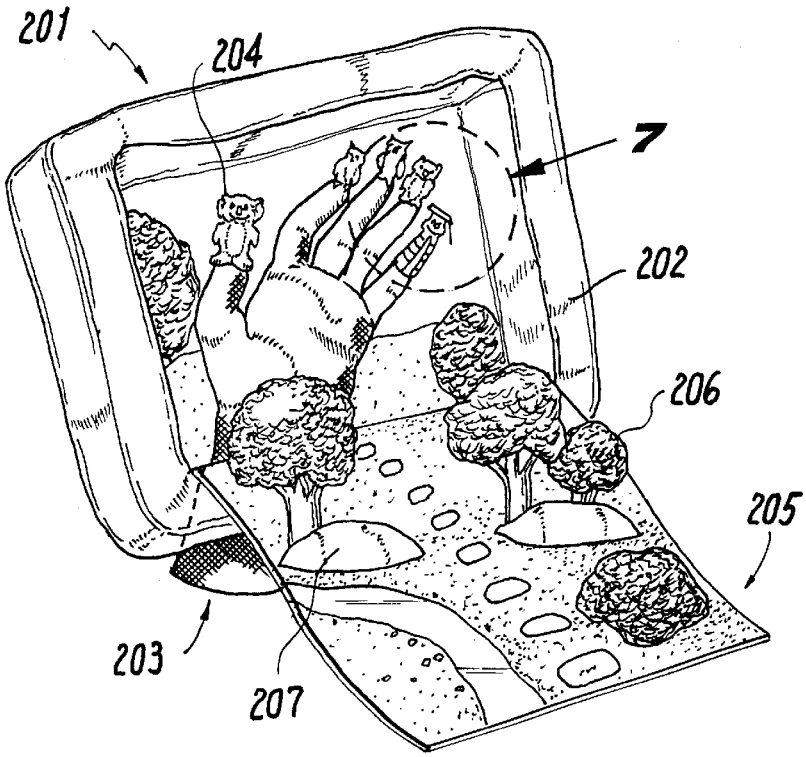
FIG. 6 is an isometric view of a further embodiment of a puppet theater accessory embodiment for a plush character toy headrest pillow; and, FIG. 7 is a close-up front elevational view of a hand of a user using optional finger puppets therewith.

In a further embodiment shown in FIG. 6, an optional puppet theater accessory 201 for a plush character toy headrest pillow may be provided behind pivotable wall portion 7 shown in FIG. 2, to reveal a soft cushioned theatrical theater set pillow 202 having built in puppet accessible sleeve 203 at a proximal open end thereof, with a puppet accessory at an opposite distal end thereof, such as finger puppets 204. A further option includes a pivotable base 205 with pop up landscape or fantasy features 206, 207 thereon, which function as a physical set for puppet accessories 204. In that way, a child can use plush character toy headrest pillow 1 as a puppet theater before retiring to sleep.

In an optional embodiment, puppet theater accessory 201 of FIG. 6 may be a stand-alone soft puppet theater removable from wall portion 7 of character pillow 1. puppet theater accessory 201 may be attached by conventional fasteners which can be separated, such as Hook and loop VELCRO® type fasteners, zippers, buttons or snaps clasps (not shown).

In an optional embodiment, puppet theater accessory 201 of FIG. 6 may be attached by sewing or other conventional permanent attachment to a conventional pillow case (not shown).

In yet another optional embodiment, puppet theater accessory 201 of FIG. 6 may be attached by sewing or other conventional permanent attachment to a fanciful pillowcase in the shape of a fanciful character, wherein when stuffed the pillow and pillow case assume the shape of a fanciful character, such as the bear shown in FIGS. 1 and 2.

Figure 1A:
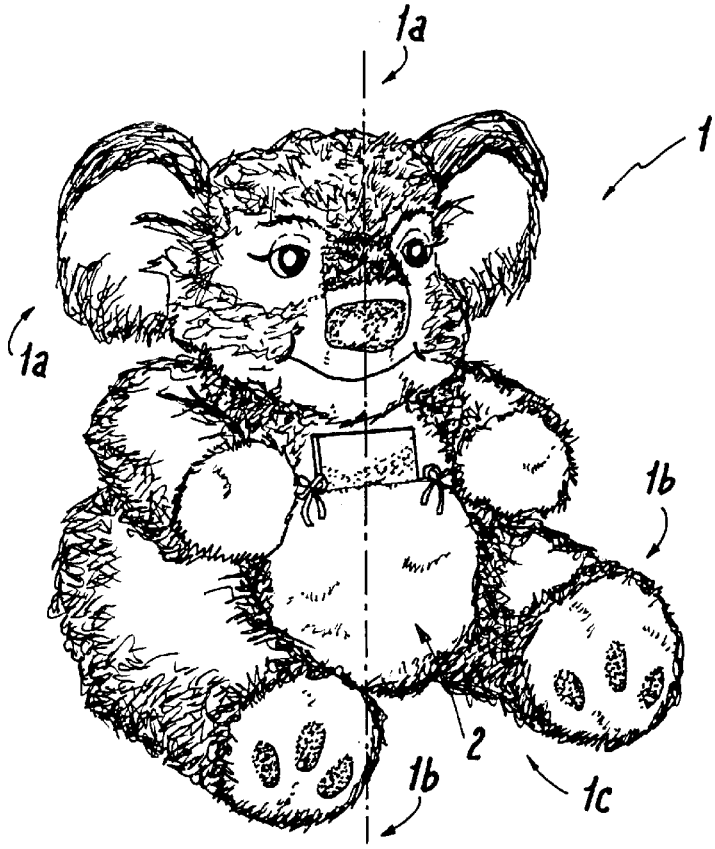
FIG. 1A is an alternate embodiment of a fanciful character pillow.
Figure 2A:
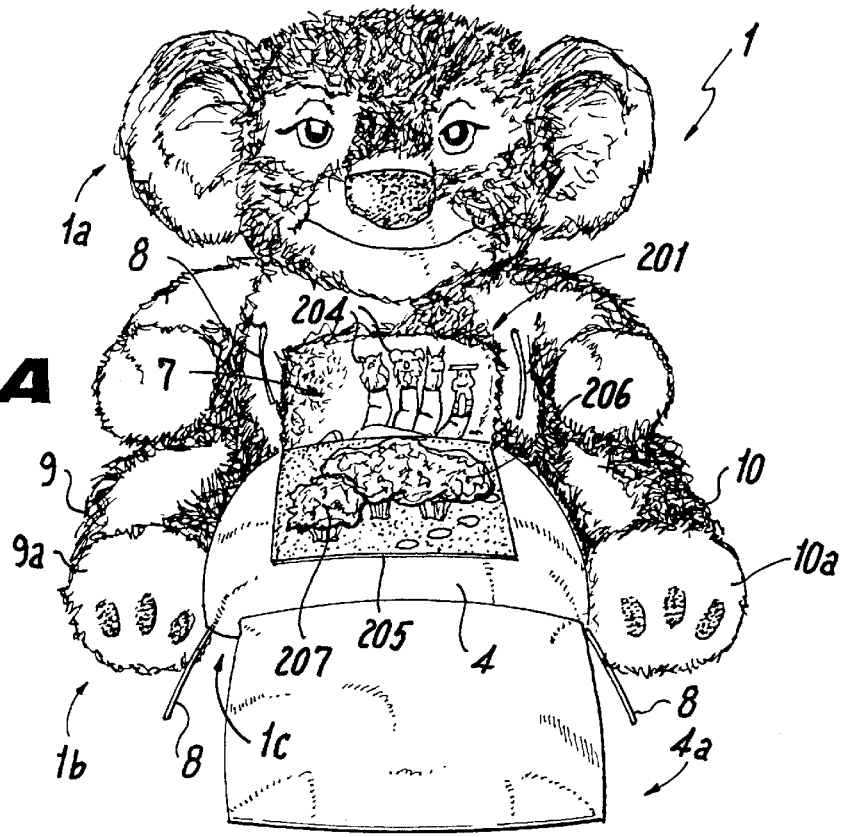
FIG. 2A is a front elevational view of the pillow as in FIG. 1A.

In still yet another further embodiment shown in FIGS. 1A and 2A, the child accommodating headrest pillow portion 4 may have a further foldable portion 4*a* which folds out from pillow portion 4, so that a child can lie on his or her abdomen in a prone position, which watching puppets 204 of puppet theater 201 having landscape features 207.

Figure 7:
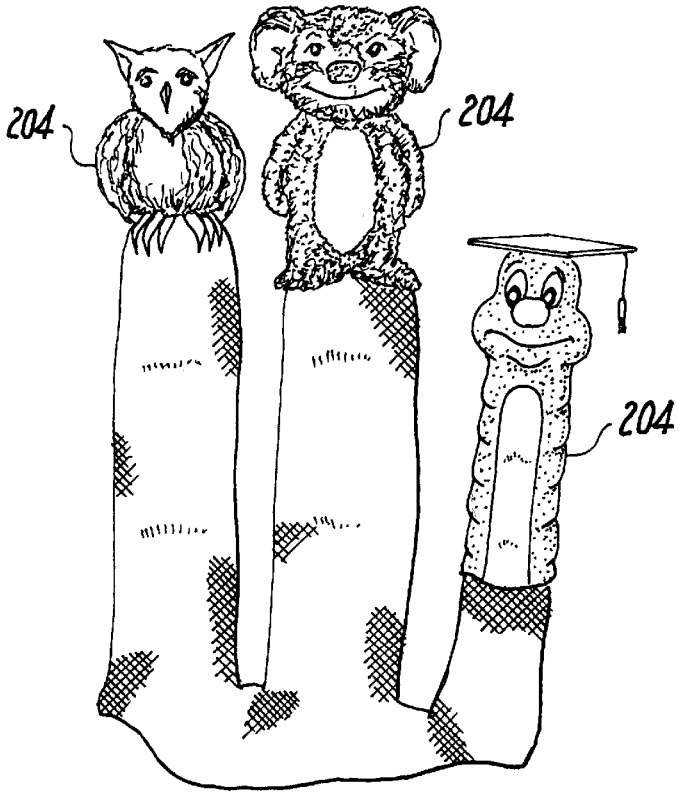

FIG. 7 is a close-up front elevational view of a hand of a user using optional finger puppets therewith.

Figure 8:
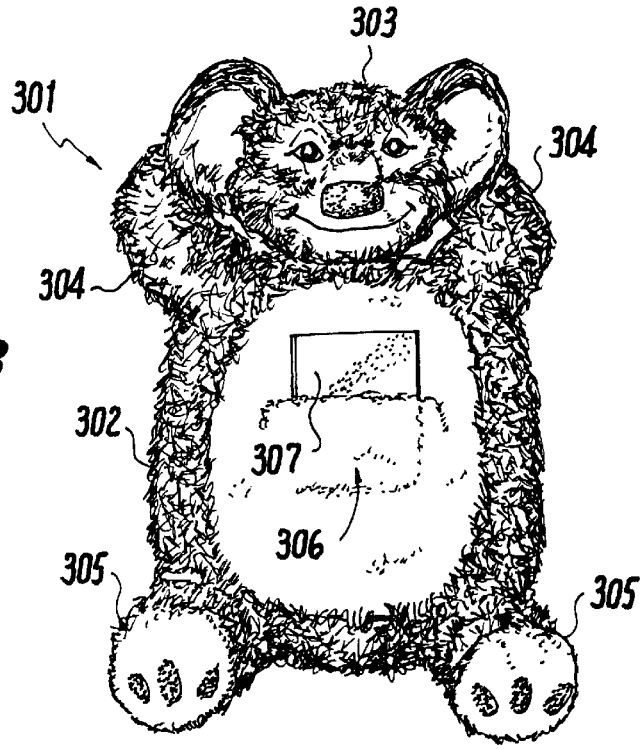
FIG. 8 is an isometric view of another embodiment for a plush character toy bolster pillow in accordance with the present invention.
Figure 9:
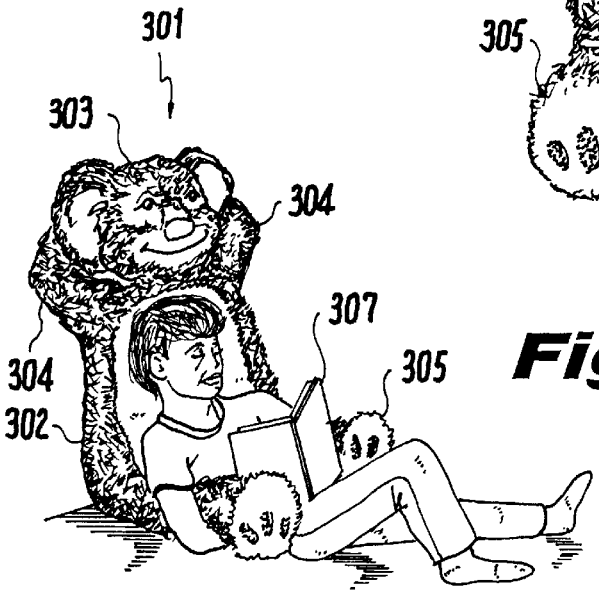
FIG. 9 is a front isometric view thereof, shown with a child resting thereon; and, FIG. 10 is a front isometric view thereof, shown with a child resting in a different position thereon.
Figure 10:
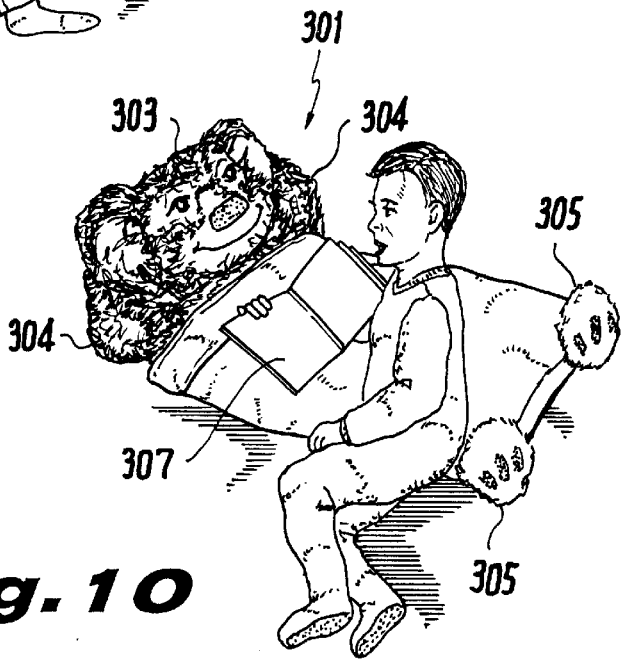

FIGS. 8, 9 and 10 show another embodiment for a plush character toy bolster pillow 301 having a soft fabric covered body 302, head portion 303, arm limb portions 304, leg limbs 305 and a pouch 306 for insertion of a manually graspable object, such as a story book 307 therein. As also shown in FIGS. 9 and 10 a child user may assume various postural positions in reclining against bolster pillow 301.

Optionally, the dual purpose plush character toy pillow headrest or bolster may be attached to an animation motor to move parts thereof, or to an audio component to play back recorded audio segments, such as portions of an appropriate story.

Optionally further, bolster pillow 301 can be just a stuffable pillowcase having the same exterior features.

It is known that other modifications may be made to the present invention without departing from the scope of the invention, as noted in the appended claims.

I claim:

1. A dual purpose plush, toy character headrest pillow comprising a plush character toy having an orthopedically correct pivotable headrest pillow portion within a pouch thereof, said pivotable pillow portion being stuffed with a soft supportive material and being provided within an abdomen portion of said plush toy character headrest pillow, wherein when said pivotable pillow portion is pivoted outward and down, said pivotable pillow portion functioning as a headrest pillow;

said plush, toy character headrest pillow having a longitudinal axis extending from an upper head and face portion down to a lower base position;

said pivotable pillow portion pivoting in an axis parallel to said longitudinal axis of said plush, toy character headrest pillow;

said plush, toy character headrest pillow further comprising a plurality of pairs of upper and lower soft limbs extending on respective left and right sides outward therefrom around said orthopedically correct pivotable pillow portion in a pivoted position of use, said pivotable pillow portion pivoting from a closed position above a space between said pair of lower limbs to an open position between said pair of lower limbs, wherein a distal portion of said pivotable pillow portion extends adjacent to respective distal portions of said pair of lower limbs, said pivotable pillow portion pivoting in an axis parallel to said longitudinal axis of said plush toy character headrest pillow.

2. The dual purpose plush, toy character headrest pillow as in claim 1 further comprising at least one manually movable recreational accessory within said pouch thereof.

3. The dual purpose plush, toy character headrest pillow as in claim 2 wherein said manually movable recreational accessory is a storybook.

4. The dual purpose plush, toy character headrest pillow as in claim 1 wherein said plush character toy is provided in a sitting up position, wherein when said pivotable headrest pillow portion is kept within the pouch in an unpivoted position of non-use, wherein said plush character toy in an upright seated position functions as a bolster for a partially seated reclining child.

5. The dual purpose plush, toy character headrest pillow as in claim 1 further comprising an animation motor to move parts thereof.

6. The dual purpose plush, toy character headrest pillow as in claim 1 further comprising an audio portion to play back recorded audio segments.

7. The plush character pillow as in claim 1 wherein said pillow includes a stuffable pillowcase which contains said soft supportive material.

8. The plush character pillow as in claim 7 wherein said pillowcase assumes the shape of a fanciful character.

9. The plush character pillow as in claim 1 wherein said pivotable pillow portion includes a further pivotable portion to accommodate a child in a prone position.

10. The dual purpose plush, toy character headrest pillow as in claim 1 further comprising a further foldable portion pivotable from said distal end portion of said pivotable pillow, said further foldable portion pivoting outward in an axis parallel to said longitudinal axis of said dual purpose plush, toy character headrest pillow.

11. The dual purpose plush, toy character headrest pillow as in claim 1 wherein said manually movable recreational accessory is at least one puppet within said dual purpose plush, toy character headrest pillow.

12. The dual purpose plush, toy character headrest pillow as in claim 11 wherein said manually movable recreational accessory is at least one physical landscape set for said at least one puppet.

* * * * *